US009502783B2

(12) United States Patent
Bleicher et al.

(10) Patent No.: US 9,502,783 B2
(45) Date of Patent: Nov. 22, 2016

(54) TWO-PART CRIMP CONTACT ELEMENT

(71) Applicant: TYCO ELECTRONICS AMP GmbH, Bensheim (DE)

(72) Inventors: Martin Bleicher, Fichtenau (DE); Josef Sinder, Ellwangen (DE); Stefan Raab, Noerdlingen (DE); Manuel Eder, Wittelshofen (DE); Gerhard Goegelein, Herrieden (DE); Erich Koehnert, Deibach (DE); Jochen Brandt, Stoedtlen (DE); Manfred Proff, Dinkelsbuehl (DE); Walter Utz, Fichtenau (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/350,049

(22) PCT Filed: Sep. 28, 2012

(86) PCT No.: PCT/EP2012/069162

§ 371 (c)(1),
(2) Date: Apr. 4, 2014

(87) PCT Pub. No.: WO2013/050299

PCT Pub. Date: Apr. 11, 2013

(65) Prior Publication Data

US 2014/0235118 A1 Aug. 21, 2014

(30) Foreign Application Priority Data

Oct. 7, 2011 (DE) ..... 10 2011 054 316

(51) Int. Cl.
*H01R 4/18* (2006.01)
*H01R 13/11* (2006.01)
(Continued)

(52) U.S. Cl.
CPC ..... *H01R 4/18* (2013.01); *H01R 13/113* (2013.01); *H01R 13/20* (2013.01); *H01R 43/048* (2013.01); *H01R 43/16* (2013.01); *Y10T 29/49218* (2015.01); *Y10T 29/5327* (2015.01)

(58) Field of Classification Search
CPC .... H01R 13/113; H01R 13/20; H01R 43/16; H01R 43/048; H01R 4/18; Y10T 29/5327; Y10T 29/49218
USPC ..... 439/878, 851–854, 866, 879, 891; 29/882, 761, 857, 861, 874, 876, 884
See application file for complete search history.

(56) References Cited

U.S. PATENT DOCUMENTS 5,399,110 A 3/1995 Morello et al.
5,573,434 A 11/1996 Ittah et al.
(Continued)

FOREIGN PATENT DOCUMENTS

CN 1111834 A 11/1995
DE 19955750 A1 5/2001
(Continued)

OTHER PUBLICATIONS

International Search Report and Written Opinion issued by the European Patent Office, dated Dec. 3, 2012, for PCT/EP2012/069162; 10 pages.
(Continued)

*Primary Examiner* — Edwin A. Leon
(74) *Attorney, Agent, or Firm* — Faegre Baker Daniels LLP

(57) ABSTRACT

The invention relates to a two-part crimped contact element. The invention further relates to a method for producing a two-part crimped contact element. The invention further relates to a device for producing a two-part crimped contact element. Previous crimped contact elements comprising two portions have a high transition resistance between the two portions and insufficient mechanical stability. The crimped contact element according to the invention overcomes these disadvantages by at least one pressure-shaped connection element being used to connect the two portions.

7 Claims, 4 Drawing Sheets

(51) Int. Cl.

| | |
|---|---|
| ***H01R 13/20*** | (2006.01) |
| ***H01R 43/16*** | (2006.01) |
| ***H01R 43/048*** | (2006.01) |

(56) References Cited

U.S. PATENT DOCUMENTS

| | | | | |
|---|---|---|---|---|
| 5,921,822 | A * | 7/1999 | Kennedy et al. | 439/851 |
| 6,254,439 | B1 * | 7/2001 | Endo et al. | 439/843 |
| 6,425,786 | B1 * | 7/2002 | Scholler | 439/843 |
| 6,619,626 | B1 | 9/2003 | Kruschinski | |
| 7,048,551 | B2 * | 5/2006 | Takayama | 439/67 |
| 7,338,334 | B2 | 3/2008 | Kumakura | |
| 7,394,044 | B2 | 7/2008 | Brun et al. | |
| 2002/0049005 | A1 | 4/2002 | Leve | |
| 2002/0187686 | A1 | 12/2002 | Zhao et al. | |

FOREIGN PATENT DOCUMENTS

| | | | |
|---|---|---|---|
| DE | 10041516 | A1 | 3/2002 |
| EP | 0106992 | A1 | 5/1984 |
| EP | 0727843 | A2 | 8/1996 |
| GB | 2383201 | A | 6/2003 |
| JP | 2003323921 | A | 11/2003 |

OTHER PUBLICATIONS

Report issued by the Deutsches Patent—und Markenamt (German Patent and Brand Office), dated Jul. 19, 2012, relating to Application No. DE 10 2011 054 316.3; 5 pages.

International Preliminary Report on Patentability issued by the International Bureau of WIPO, Geneva, Switzerland, dated Apr. 8, 2014, for International Application No. PCT/EP2012/069162; 6 pages.

English translation of the Second Office Action issued by the Chinese Patent Office, dated Jun. 22, 2016, for Chinese Patent Application No. 201280048749.2; 9 pages.

* cited by examiner

TWO-PART CRIMP CONTACT ELEMENT

The invention relates to a two-part crimped contact element. The invention further relates to a method for producing a crimped contact element from at least two portions. The invention further relates to a device for producing a two-part crimped contact element.

BACKGROUND

Crimped contact elements comprise a crimped wire portion to which a wire or a cable can be secured and a contact member which is used for connection to a mating connector. In order to combine these two functional components, which have different requirements, in the greatest possible number of combinations in a crimped contact element, modular crimped contact elements comprising two portions which can be connected to each other already exist. U.S. Pat. No. 7,338,334 B2, for example, sets out such a modular system. However, the crimped contact element which is set out therein does not have adequate transition resistance between the two portions. Furthermore, the connection can be subjected to only low levels of mechanical loading. Furthermore, such crimped contact elements are difficult to produce and consequently costly.

SUMMARY

An object of the invention is to provide a crimped contact element which is simple to produce and which has, for example, compared with U.S. Pat. No. 7,338,334 B2, reduced transition resistance and improved mechanical load capacity.

This object is achieved according to the invention for the crimped contact element mentioned in the introduction in that the at least two portions are joined together by means of at least one pressure-shaped connection element. In contrast to the connection set out in the prior art by means of bending, this type of connection provides a sufficiently large contact face with an intimate connection between the two portions. Consequently, the electrical resistance is small and the mechanical stability high. Furthermore, such a pressure shaping operation can be readily carried out in a single method step, which reduces costs.

The solution according to the invention can be freely combined and further improved with the following additional embodiments which are each advantageous per se.

It may be particularly advantageous for the at least two portions to be joined together exclusively by means of at least one pressure-shaped connection element. This further simplifies the production method. In many cases, the conductivity and mechanical stability achieved thereby is sufficient to comply with the corresponding standards.

In another advantageous embodiment, the crimped wire portion has a crimped insulation portion and a crimped core portion. The crimped insulation portion serves to be crimped with respect to an insulation of a cable and constitutes mechanical tensile relief for the cable. The crimped core portion serves to be crimped with respect to a metal core of a cable, for example, a wire or strands. This crimped core portion ensures the electrical connection between the cable or wire and the crimped contact element.

It may be particularly advantageous for the crimped contact element to comprise more than two, for example, three portions. In this instance, two portions may each be joined together again by means of at least one pressure-shaped connection element or a total of precisely only two portions may be joined together by means of such a pressure-shaped connection element and the other connections may be produced using other joining techniques.

In a particularly advantageous embodiment of the crimped contact element, one portion has at least one pressure-shaped extension which protrudes through an opening of the other portion. For example, when the crimped contact element is produced, an extension of a first portion may be guided through an opening of the other portion and the extension may be shaped by means of compression, as is the case for a rivet, in such a manner that the two portions are securely pressed one against the other. In particular, the pressure-shaped extension may completely fill the cross-section of the opening.

In order to produce a secure connection between the two portions, there may also be provided a plurality of pressure-shaped extensions which protrude through one or more openings of another portion. For example, one portion may have two extensions and the other portion may have two openings. Another possibility is that each portion has one opening and one extension which are connected to an extension or an opening of the other portion, respectively.

In another advantageous embodiment, the at least one pressure-shaped connection element is produced by means of clinching. This technique which is also known as pressure joining produces a connection between two sheets without an opening having to be provided on one of the portions. In the same manner as the connection by means of a pressure-shaped extension, the connection by means of clinching is also positive-locking and non-positive-locking.

In addition to the connection by means of at least one pressure-shaped connection element, at least two portions may be welded to each other. This further improves the electrical resistance and the mechanical stability and produces a materially-engaging connection between the two portions. For example, weld seams may be provided. A connection by means of spot welding or extensive welding is also possible. In this instance, additional materials may be applied or the welding may be carried out, for example, by means of current flow.

In order to further reinforce one of the portions, additional elements or constructions, such as beads or thickened portions, may be provided.

Owing to the two-part construction, it is possible for at least two portions to comprise different materials. In particular, the material may be adapted to the respective function, that is to say, for example, the crimped function or the insertion function. For instance, the crimped wire portion may thus be composed of low-alloy copper materials since this region is provided above all for contacting with respect to the wire and may be softer. The contact member may comprise, for example, a more highly alloyed material since this is intended to be more rigid.

In most cases, it is advantageous for the individual portions to be formed from a uniform material in each case. However, it is also possible for a portion to be produced, for example, from several layers of different materials. For example, an inner side may comprise a different material from an outer side. In particular, the individual portions may also be coated, for instance, in order to prevent corrosion.

Although the conductive portions comprise metal, other functional portions, such as a crimped insulation portion, may comprise non-metals. Consequently, the costs can be further reduced and the material properties better adapted to the function.

The invention is explained in greater detail below by way of example with reference to advantageous embodiments and the drawings. The embodiments described are only possible embodiments, in which the individual features, as described above, may, however, be combined independently of each other or omitted. Reference numerals which are the same in the different drawings refer to the same objects.

DETAILED DESCRIPTION

Figure 1B:
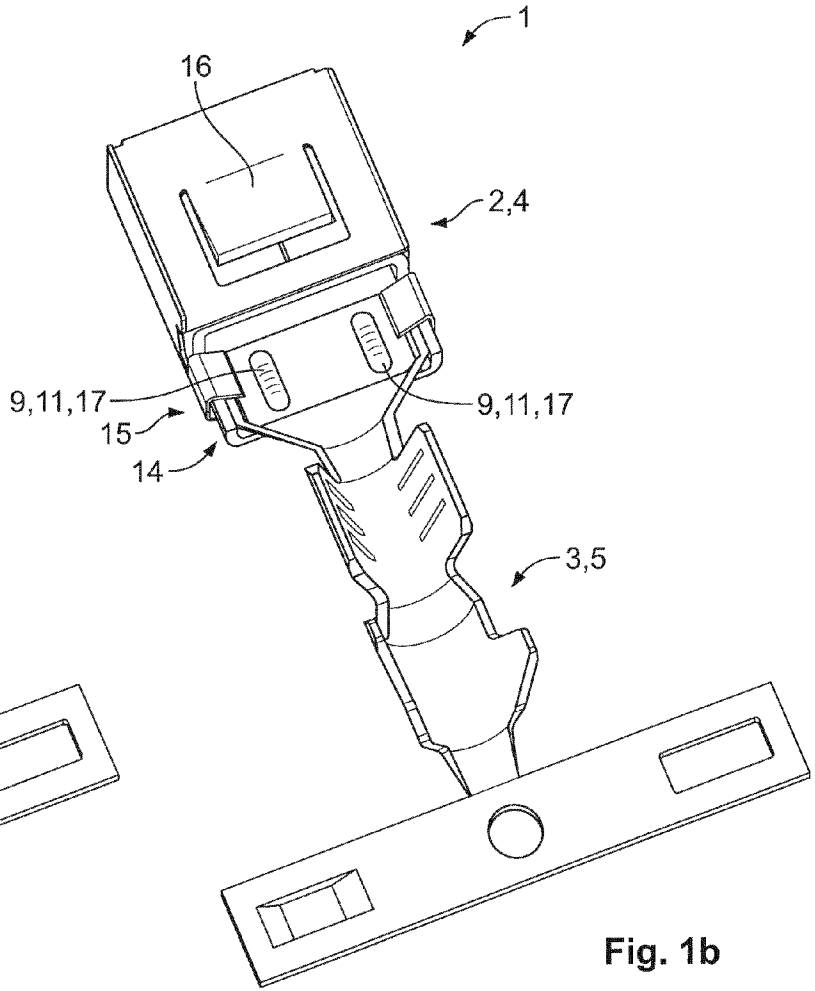
FIG. 1 is a schematic, perspective view of a crimped contact element according to the invention before and after the pressure-shaping step.
Figure 1A:
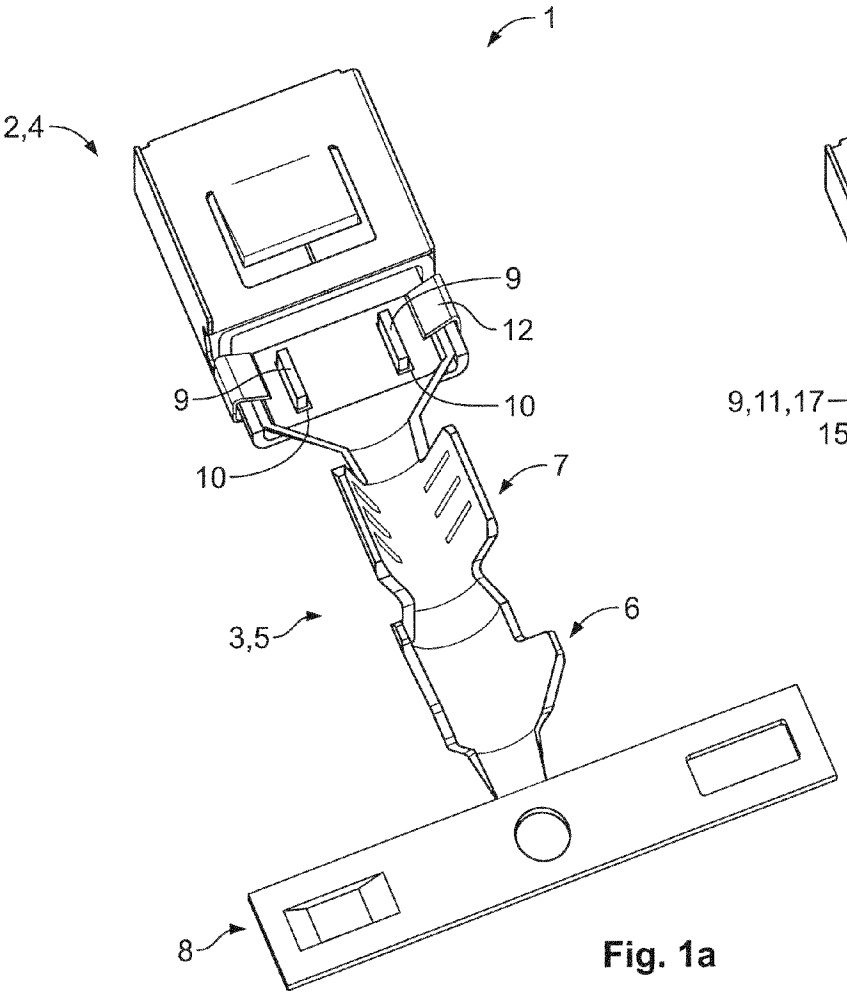

FIG. 1 illustrates a crimped contact element 1 according to the invention during its production. A first portion 2 of the crimped contact element 1 is connected to a second portion 3 of the crimped contact element 1. The first portion 2 acts as a contact member 4 for contacting with respect to a mating connector. The second portion 3 is a crimped wire portion 5 which in this example has a crimped insulation portion 6 for crimping with respect to the insulation of a cable and a crimped core portion 7 for crimping with respect to the core of a cable. Furthermore, the crimped contact element 1 has a retention portion 8 which can, however, be separated from the crimped contact element 1 in another step.

In the production step A illustrated at the left-hand side, the first portion 2 and the second portion 3 are still in loose contact with each other. Two extensions 9 of the first portion 2 have been introduced through openings 10 of the second portion 3 and protrude from the second portion 3.

At the right-hand side B, the crimped contact element 1 is illustrated after the production of two pressure-shaped connection elements 17. The extensions 9 of the first portion 2 have been plastically deformed by means of mechanical pressure and now securely connect the first portion 2 to the second portion 3. Owing to the permanent, plastic deformation of the extensions 9, these become pressure-shaped extensions 11. The first portion 2 can thus be released from the second portion 3 only by means of great force. In particular, during such a release operation, at least one portion is in most cases damaged or destroyed.

In the state A, the second portion 3 may be retained by means of retention elements 12 of the first portion 2. For example, the second portion 3 may snap-fit into these retention elements 12.

The extensions 9 of the first portion 2 may be formed, for example, by flaps 13 which have been bent over.

In this example, the first portion 2, which forms the contact member 4 for connection to a mating connector comprises a lower portion 14 to which an additional spring 15 is fitted for mechanical stabilisation. This spring 15 further has a locking pawl 15 which can engage in a counter-contact.

Figure 2A:
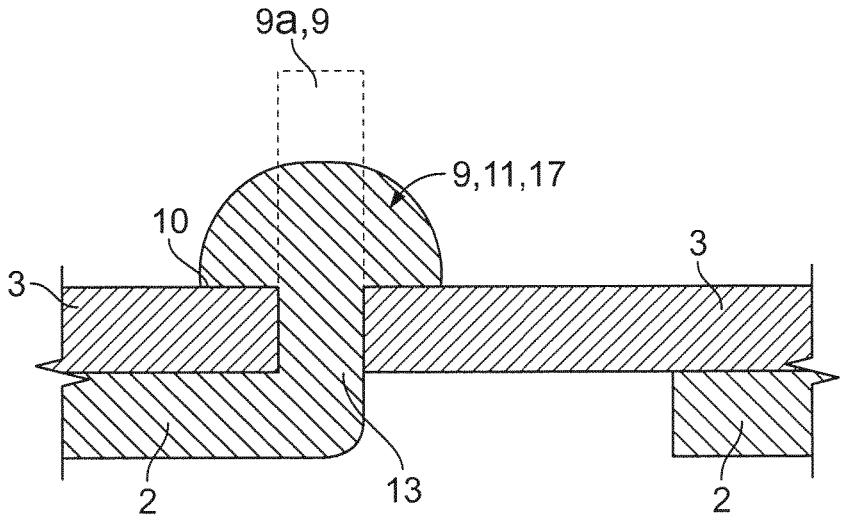
FIG. 2*a* is a schematic sectioned view of a first embodiment of a pressure-shaped connection element according to the invention.

FIG. 2*a* is a schematic cross-sectional view of a pressure-shaped connection, as shown, for example, in FIG. 1.

A flap 13 of the first portion 2 has been bent upwards and guided through an opening 10 of the second portion 3. It forms an extension which is not yet pressure-shaped 9*a*. In another step, the extension 9 has been shaped by means of pressure shaping to form a pressure-shaped extension 11 and now forms the pressure-shaped connection element 17. This pressure-shaped extension 11 has in this view a mushroom-like cross-section. The originally flat metal sheet of the extension which has not yet been shaped 9*a* has its shape permanently changed and is now substantially thicker.

The extent in the direction of the plane of the two portions and transversely relative to the direction of the extension may be only small. For instance, this pressure-shaped connection element 17 may be rather point-like or button-like. However, the connection element, and consequently the connection, may also have a greater extent, for example, it may be linear, circular or polygonal.

The pressure-shaped connection element 17 produced in the form of a pressure-shaped extension 11 constitutes a secure connection between the first portion 2 and the second portion 3. Owing to the intimate connection of the first portion 2 to the second portion 3, the electrical resistance between both is low and the mechanical stability high.

The material of the first portion 2 may be selected in such a manner that it readily becomes deformed. Other aspects, such as, for example, rigidity, toughness, conductivity or chemical stability, may also be significant in the selection of the material.

The illustrated mushroom-like cross-section of the pressure-shaped extension 11 constitutes a simple possibility for uniform distribution of the pressure which occurs between the second portion 3 and the pressure-shaped extension 11. Nonetheless, other shapes of the cross-section, for example, a hammer-head-like or T-shaped configuration, may be selected since these may enable, for example, a better support face or a smaller structural height.

Figure 2B:
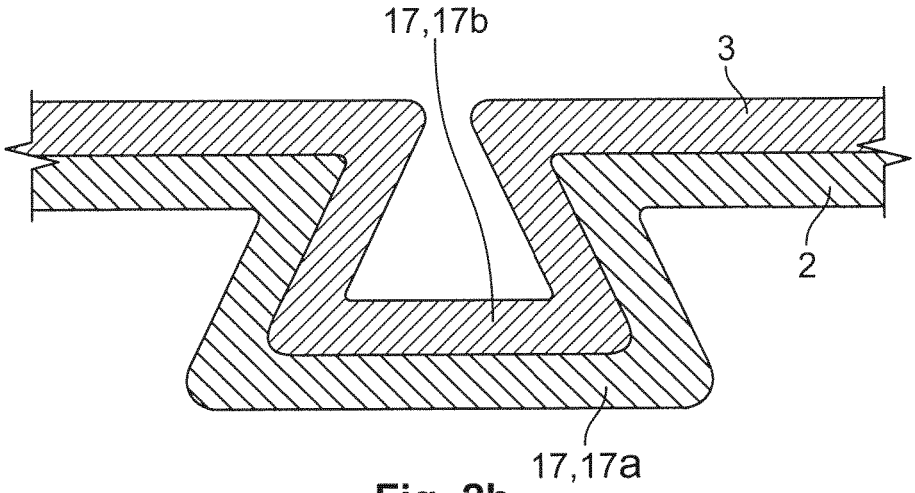
FIG. 2*b* is a schematic sectioned illustration of a second embodiment of a pressure-shaped connection element according to the invention.

FIG. 2*b* is a schematic cross-section of a second possibility for configuring at least one pressure-shaped connection element 17 for connecting a first portion 2 and a second portion 3.

The pressure-shaped connection element 17 was produced in this instance by means of clinching, also known as pressure joining. The second portion 3 is connected to the first portion 2 in the manner of a push-button. Owing to the specific configuration of the connection cross-section, it is consequently made more difficult for the second portion 3 to slide out of the first portion 2.

The pressure-shaped connection element 17 may be produced by means of pressure-shaping the first portion 2 and lead to a first pressure-shaped connection element 17*a*. Accordingly, the second portion 3 may also be pressure-shaped, which leads to a second pressure-shaped connection element 17*b*. In particular, both portions may also be pressure-shaped at the same time and/or together.

The deformation may be carried out, for example, by means of an upper die and a bottom die. Owing to the expansion of the two portions, the portions may be thinner at the connection location than at other locations.

The spatial shape of the connection which is produced may be, for example, circular or rectangular when viewed from above or may also have any other shape.

Figure 3:
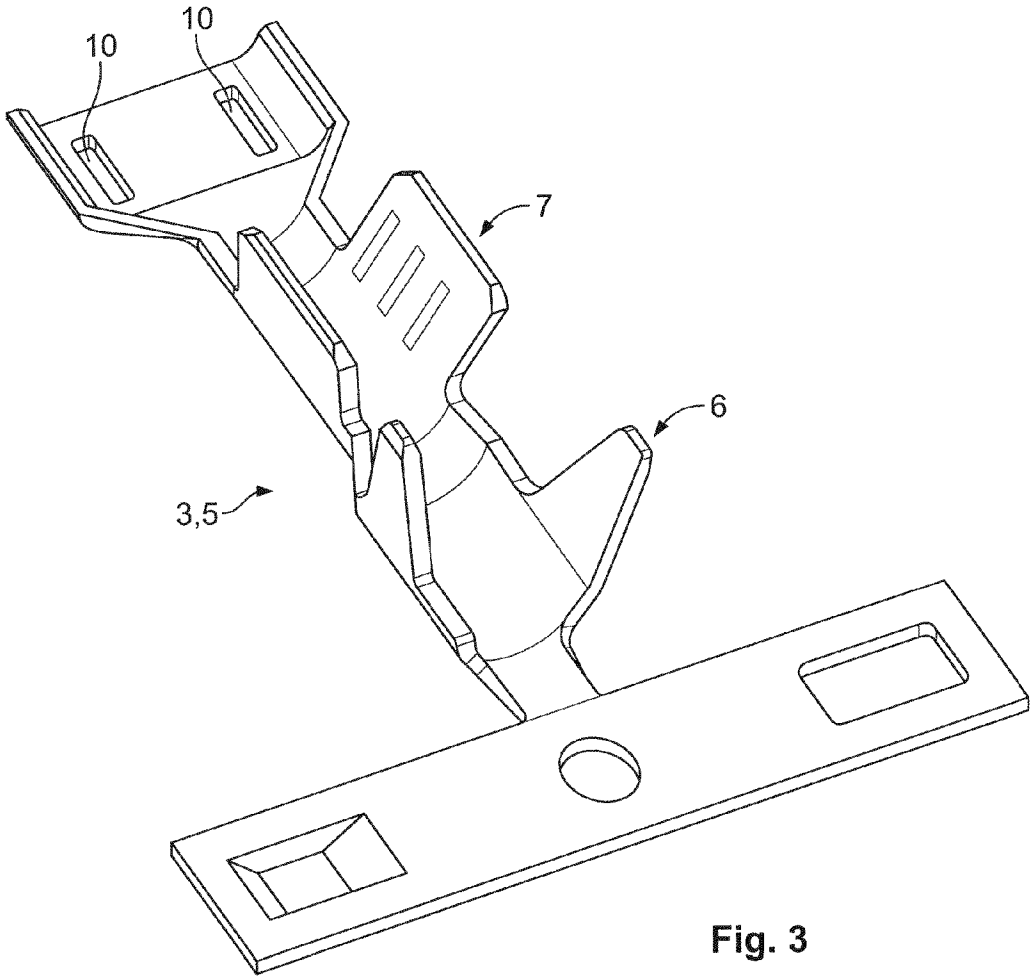
FIG. 3 is a schematic, perspective view of a first portion of a crimped contact element according to the invention.

FIG. 3 is a schematic, perspective view of the second portion 3 which is illustrated in FIG. 1 and which constitutes the crimped wire portion 5 with the crimped insulation portion 6 and crimped core portion 7. In particular, it is possible to see clearly here the openings 10 of the second portion 3 through which the extensions 9 of the first portion are guided. There is further illustrated an advantageous embodiment of the end 19 which faces the first portion 2 and which is connected thereto in the finished component. The configuration of the end 19 shown here is adapted to the inner contour of the first portion 2.

For further mechanical stabilisation, additional elements, such as, for example, beads, may also be provided on one of the portions.

Figure 4:
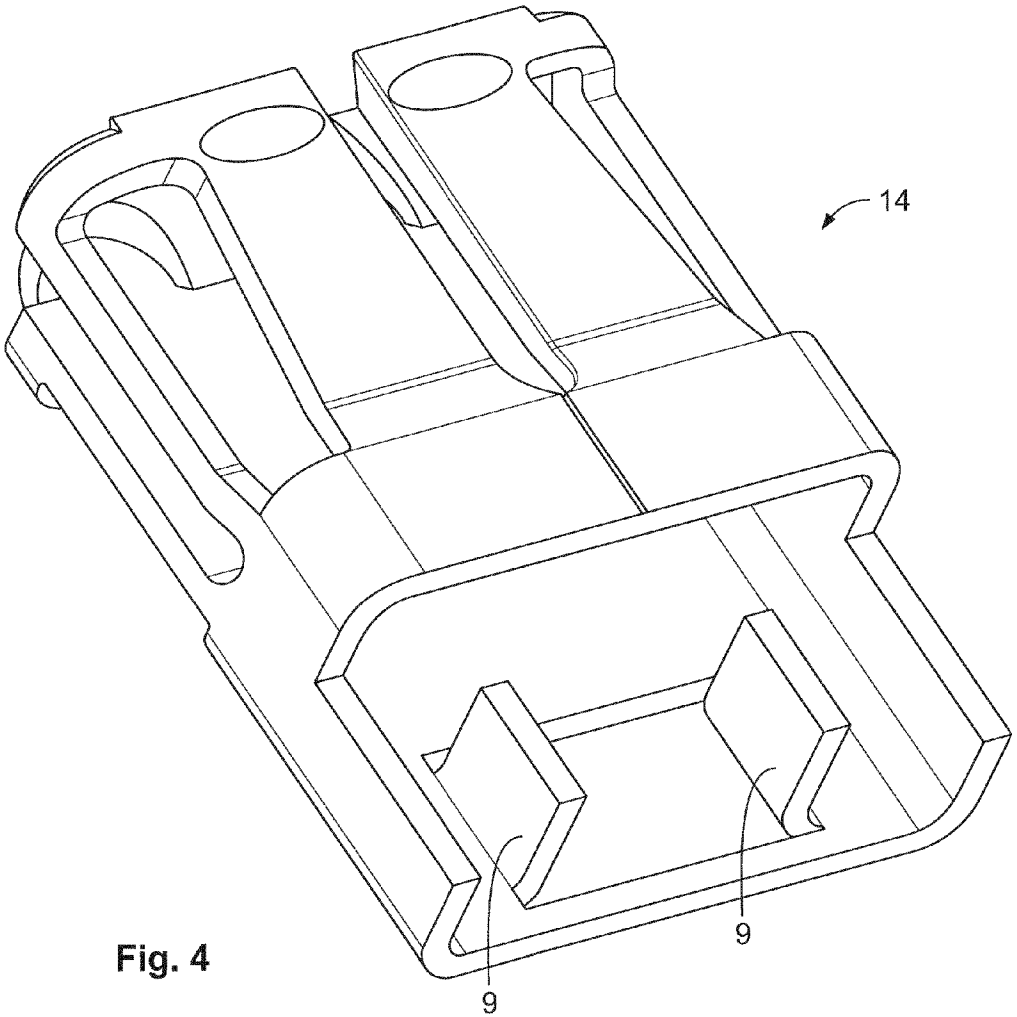
FIG. 4 is a schematic, perspective view of a second portion of a crimped contact element according to the invention.

FIG. 4 is a schematic perspective view of the lower portion 14 of the first portion 2 illustrated in FIG. 1. The first portion 2 illustrated here is punched from sheet metal and bent. In particular, the flaps 13 which act as extensions 9 are produced by means of bending.

The invention claimed is:

1. A crimped contact element comprising a crimped wire portion for securing a wire or a cable and a contact member for connection to a mating connector, the crimped contact element being produced from at least two portions, the at least two portions being joined together by means of at least one pressure-shaped connection element, wherein one of the crimped wire portion and the contact member includes an opening and the other of the crimped wire portion and the contact member includes an extension extending through the opening, and the extension being deformed such that the cross-sectional configuration of the extension is changed to overly the opening and defining the pressure shaped connection element, and wherein the one of the crimped wire portion and the contact member having the opening, includes an upper open and substantially flat face, and the one of the crimped wire portion and the contact member having the extension, includes a lower open and substantially flat face, with the faces overlapping each other.

2. The crimped contact element according to claim 1, wherein the crimped wire portion comprises a crimped insulation portion for being crimped with respect to an insulation of a cable and a crimped core portion for being crimped with respect to a metal core of the cable.

3. The crimped contact element according to claim 1, wherein at least one pressure-shaped connection element is produced by means of clinching.

4. The crimped contact element according to claim 1, wherein at least two portions are additionally welded to each other.

5. The crimped contact element according to claim 1, wherein the at least two portions comprise different materials.

6. A method for producing a crimped contact element from at least two portions, wherein at least one of the two portions is pressure-shaped and the at least one portion is connected to at least another of the two portions during the pressure-shaping operation, the method comprising a first step of providing retention between the two portions, and wherein the second step includes pressure shaping that creates a deformation of at least one of the two portions, the deformation changing a cross-sectional configuration of the one portion and overlying and interengaging with the other of the two portions creating a connection between the two portions.

7. A crimped contact element comprising a crimped wire portion for securing a wire or a cable and a contact member for connection to a mating connector, the crimped contact element being produced from at least two portions, wherein the at least two portions are joined together by means of at least one pressure-shaped connection element, the pressure shaped connection element interengaging between both the crimped wire portion and the contact member wherein both of the crimped wire portion and the contact member include complementary deformed portions defining the pressure shaped connection element.

* * * * *